US007288900B2

(12) United States Patent
Biebl et al.

(10) Patent No.: US 7,288,900 B2
(45) Date of Patent: Oct. 30, 2007

(54) ILLUMINATION SYSTEM HAVING AT LEAST TWO LIGHT SOURCES, AND A METHOD FOR OPERATING SUCH AN ILLUMINATION SYSTEM

(75) Inventors: Alois Biebl, St. Johann (DE); Stefan Hackenbuchner, München (DE); Gunther Hirschmann, München (DE); Reinhard Weitzel, Gernlinden (DE)

(73) Assignee: Patent-Treuhand-Gesellschaft für Elektrische Glühlampen mbH, Munich (DE)

( * ) Notice: Subject to any disclaimer, the term of this patent is extended or adjusted under 35 U.S.C. 154(b) by 238 days.

(21) Appl. No.: 11/218,624

(22) Filed: Sep. 6, 2005

(65) Prior Publication Data

US 2006/0061300 A1 Mar. 23, 2006

(30) Foreign Application Priority Data

Sep. 20, 2004 (DE) ..... 10 2004 045 515

(51) Int. Cl.
*G05F 1/00* (2006.01)

(52) U.S. Cl. ..... 315/291; 315/307; 315/312

(58) Field of Classification Search ..... 315/224, 315/291, 307, 312, 360, 225, 293, 294
See application file for complete search history.

(56) References Cited

U.S. PATENT DOCUMENTS

| | | | | |
|---|---|---|---|---|
| 3,898,643 | A * | 8/1975 | Ettlinger | 700/84 |
| 6,175,201 | B1 * | 1/2001 | Sid | 315/312 |
| 6,175,771 | B1 * | 1/2001 | Hunt et al. | 700/3 |
| 6,728,393 | B2 * | 4/2004 | Stam et al. | 382/104 |
| 2007/0029951 | A1 * | 2/2007 | Lamesch | 315/360 |

* cited by examiner

*Primary Examiner*—Douglas W. Owens
*Assistant Examiner*—Jimmy Vu
(74) *Attorney, Agent, or Firm*—Carlo S. Bessone

(57) ABSTRACT

An illumination system has at least two light sources of which at least one light source includes an LED, and a driver device designed to operate at least the one LED with a DC signal; a sensor device for determining at least one feature of the light output; an actual value storage device connected to the sensor device for storing an actual value of the feature; a setpoint selection device for storing a setpoint of the feature; and a control device connected on the input side to the actual value storage device for of transmitting the actual value, and to the setpoint selection device for transmitting the setpoint, and which provides the driver device with a control signal that changes a characteristic of the DC signal used for driving the LED such that the actual value approaches the setpoint.

14 Claims, 1 Drawing Sheet

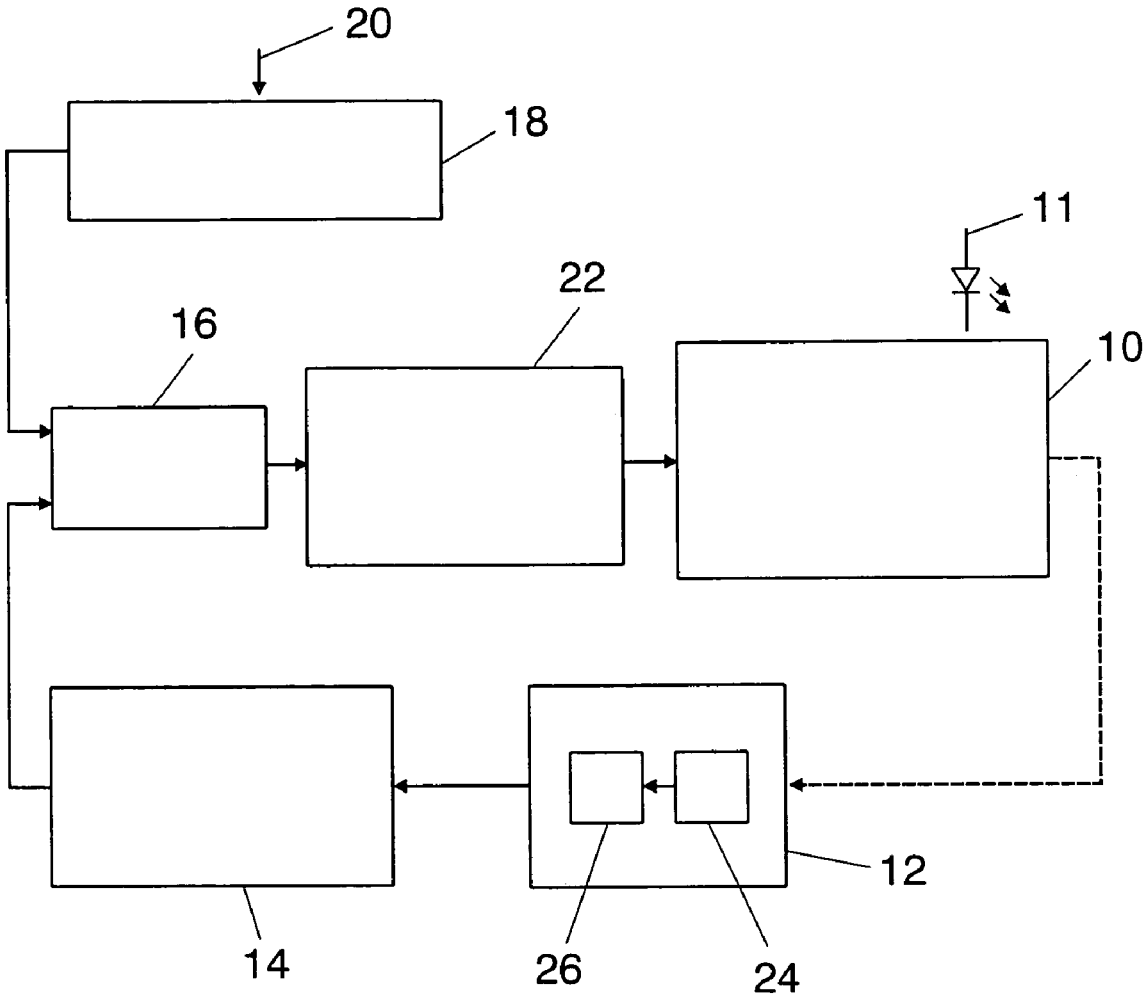
20
18
11
22
16
10
12
14
26
24

ILLUMINATION SYSTEM HAVING AT LEAST TWO LIGHT SOURCES, AND A METHOD FOR OPERATING SUCH AN ILLUMINATION SYSTEM

FIELD OF THE INVENTION

The present invention relates to an illumination system having at least two light sources of which at least one light source comprises an LED. It relates, moreover, to a method for operating such an illumination system.

BACKGROUND OF THE INVENTION

Illumination systems of said type are sufficiently well known in the prior art, the simplest method of operating LEDs consisting in connecting the LED to a DC source together with a series resistor. The series resistor is used to limit the light-emitting diode current $I_F$ (conducting-state current). The conducting-state current $I_F$ can be varied by varying the series resistor, as the result of which the brightness of the light emitted by the light-emitting diodes is likewise varied. It is possible in this simple way to achieve the dimmability of a system that can comprise light-emitting diodes and other luminous means as light source. However, one problem consists in that with some LEDs, in particular with InGaN LEDs, there is a more or less strong relationship between the current intensity of the conducting-state current $I_F$ and the associated wavelength of the emitted light. Depending on the conducting-state current $I_F$, a shift occurs here in wavelength or color locus, that is to say when dimming there is a simultaneous change in the wavelength, and thus in the color, of the emitted light.

Re color locus: In the case of the standard valence system, a color is described as the sum of three mixing values, the so-called standard color values X, Y, Z (DIN 5033). The standard color value components Cx and Cy are frequently also specified for the purpose of two-dimensional representation, in which case Cx=X/(X+Y+Z) and Cy=Y/(X+Y+Z). In the case of the graphic representation of chromaticity in a two-dimensional chromaticity diagram, Cx and Cy serve as rectangular coordinates of the so-called color loci.

The phenomenon of color locus displacement can be observed most impressively with green LEDs. With type LT E673 (power TOPLED), the dominant wavelength is above 540 nm given a conducting-state current of 3 mA, and drops below 512 nm when the conducting-state current rises to 90 mA. With an LED of type LW W5SG (dragon), the color locus changes in a fashion defined by Cx and Cy from Cx=0.322 and Cy=0.316 for a conducting-state current of 100 mA to Cx=0.316 and Cy=0.301 for a conducting-state current $I_F$=1000 mA.

The principle of pulse width modulation is applied in the prior art in order to solve this problem, that is to say to keep constant the color locus of the light emitted by the LED. In this case, an LED is switched on and switched off again over a period T always with the same conducting-state current $I_{Fmax}$. The pulse duty factor, which is calculated from the quotient of the switch-on time $t_p$ divided by the period T, determines the brightness of the light emitted by the LED. A large pulse duty factor leads to a brightly shining LED, or conversely a small pulse duty factor leads to a more weakly shining LED. In this case, the integration of the light emitted by the LED is undertaken by the human eye. For periods T shorter than 10 ms, the light is registered as continuous by the eye. Flickering of the light can be perceived by the eye in the case of longer periods.

This driving known from the prior art poses no problem in the case of low powers. Upon transition to higher powers, however, as is required in the case of lamps for general lighting or use in a motor vehicle, undesired interference can arise. Two types of interference essentially come into consideration in this case, specifically radio interference (EMC) and conducted interference.

In order to prevent such electromagnetic interference, the appropriate standard from BMW provides that the rising edge is at most 20 mA/μs in clocked operation. If this limit is adhered to, this results in very long switch-on and switch-off times and, in association therewith, very high switching losses. Thus, with the measures known from the prior art, a decision has to be made for one of the evils, either interference or color locus displacements or high switching losses.

SUMMARY OF THE INVENTION

The present invention is therefore based on the object of developing an illumination system of the type mentioned at the beginning, or the method mentioned at the beginning, in such a way that the brightness can be varied while the color locus remains largely constant, however, without the occurrence of interference or high switching losses.

The present invention is based on the finding that the first step in avoiding interference is to change from clocked operation to DC operation. The color locus variation occurring in the dimmed operation in the case of DC driving is, however, detected according to the invention, and the DC signal used for driving the at least one LED is changed in such a way that the desired brightness is set, the color locus remaining largely unchanged.

Owing to the fact that it is possible to make use in the illumination system of at least two light sources of which the light exhibits different spectra, it is possible, depending on which requirements exist and the level of complication of operation, to drive the individual light sources from which the illumination system is formed in a different way so as to achieve desired color locus displacements of the light output by the illumination system, which is composed of the light of the individual light sources. When, in a simple exemplary embodiment, for example, the illumination system comprises a number of LEDs that emit light of different color loci, for example red, green and blue light, it is possible to correct a color locus displacement effected during dimming when the individual LEDs are driven with altered parameters after the dimming.

A preferred embodiment is distinguished in that the sensor device comprises at least one voltage frequency converter. Particularly in connection with appropriate filter devices, for example for the blue, the red and the green spectral region of the light output by the illumination system, the light components situated in a specific spectral region can be determined by counting the pulses output by the respective voltage frequency converter. If the control device comprises a microprocessor that is connected to the output of the at least one voltage frequency converter, this can count the pulses in the output signal of the at least one voltage frequency converter without any need for the interposition of an A/D converter. Thus, the standard color values X, Y, Z are reflected in a simple way as the number of pulses per time unit. It is possible to determine the standard color value components Cx and Cy therefrom (see above). Alternatively, the filter devices can provide voltage signals that are evaluated by the microprocessor with the interposition of at least one A/D converter.

In one illumination system according to the invention, in addition to the at least one light source that comprises at least one LED, at least one further light source may be present that can preferably be selected from the following types: LED, fluorescent lamp, halogen incandescent lamp, high pressure discharge lamp. The at least one feature of the light output by the illumination system can be the color temperature and/or the brightness and/or the color locus.

It can preferably further also be provided that the setpoint selection device has an interface into which at least one setpoint can be input by an operator, or at least one setpoint can be selected from a number of setpoints already stored in the setpoint selection device. It is thereby possible to use the same illumination of a room to engender different moods. During operation in a motor vehicle, it is possible to implement country-specific color temperatures or fashion colors, for example Cool Blue.

It is preferred furthermore when the components of the illumination system are designed for operation in a motor vehicle, in particular the supply voltage required for operating the components, and the quality of the light output by the illumination system. Since an illumination system according to the invention can be used to set the brightness independently of the color temperature, it is possible thereby to implement dimmable headlights. This property is very important for daytime running light, which is already prescribed in many countries. To date, halogen lamps having a color temperature of, for example, 3200 K for H4 lamps or high pressure discharge lamps (D2/D1 lamps) having a color temperature of 4200 K have been used for headlights, and these can also be operated as daytime running lights. The disadvantage consists in that the service life is very limited. This is several 100 hours for halogen lamps, and approximately 3000 hours for D2/D1 lamps. Because, inter alia, of said undesired color locus displacements, it has not so far been possible for LEDs, which have a service life of typically more than 10 000 hours, to be used as headlights with a daytime light option.

The driver device can be designed to operate all the light sources of the illumination system. Alternatively, the light sources of the illumination system, grouped particularly by type, can also be driven independently of one another.

Parameters for operating the light sources can be stored in the driver device for the case in which the sensor device and/or the actual value storage device and/or the setpoint selection device fails. It can be provided in this case that the light sources are driven in such a way that they produce white light with preset values. Alternatively, it can be provided that a color temperature is predefined by the user and stored in a storage unit, for example, for the case of a fault.

The determination of the at least one feature of the light output by the illumination system according to the invention can be performed entirely independently of the driving of the at least one LED. In the case of pulse-width-modulated operation of the LED, the respective feature would need to be determined together with an increase in complexity precisely when the appropriate LED is switched on. By contrast, an illumination system according to the invention is distinguished by being easier to implement and of greater reliability.

Not only in conjunction with the implementation of a daytime running light or of a parking light where use is made of an illumination system according to the invention in a motor vehicle, but also in the case of a general illumination system, for example for illuminating a living room, a setpoint can correspond to a dimming position of the illumination system.

Other advantageous embodiments of the invention are to be found in the subclaims.

BRIEF DESCRIPTION OF THE DRAWING

In what follows, an exemplary embodiment of the invention will now be described in more detail with reference to the attached drawing, which includes one FIGURE. The FIGURE shows a schematic of an illumination system according to the invention.

DETAILED DESCRIPTION OF THE INVENTION

FIG. 1 shows a schematic of an illumination system according to the invention. It comprises a number of light sources that are combined in a block 10, at least one light source being—as illustrated schematically—an LED 11 that is operated with a DC signal. The light output by the block 10 is sensed by a sensor device 12 with the aid of which at least one feature of the light output by the illumination system can be determined. The color temperature, the brightness or the color locus come into consideration as features. The at least one feature determined by the sensor device 12 is stored in an actual value storage device 14. The actual value storage device 14 can be designed for storing the values of a number of features. The actual value of the at least one feature is made available to a control device 16. The latter is also provided by a setpoint selection device 18 with a setpoint of the at least one feature. This device can also be designed for storing a multiplicity of values of features. This has an interface 20 via which at least one setpoint can be input by an operator, or at least one setpoint can be selected from a number of setpoints already stored in the setpoint selection device 18. The control device 16 compares the setpoint of the at least one feature with the actual value of the at least one feature and, at its output, provides a driver device 22 with a control signal in such a way that the driver device changes a characteristic of the DC signal used to drive the at least one LED such that the actual value of the at least one feature approaches the setpoint of the at least one feature. As already mentioned, nothing except LEDs can be present in block 10 as light sources, but it is also possible to combine LEDs with other types of light sources, for example high pressure discharge lamps, halogen incandescent lamps, fluorescent lamps. The driver device 22 can be designed to change only the signals used to drive the at least one LED, but it can also be designed to modify in addition the drive signals of the other light sources. A filter device 24 and a voltage frequency converter 26 are illustrated schematically in the sensor device 12. Three such combinations of filter device 24 and voltage frequency converter 26 are preferably present in order to determine the standard color values X, Y, Z. The output signals of the three voltage frequency converters 26 are fed to a microprocessor that determines the standard color values X, Y, Z in a simple way by counting the pulses. It can optionally be provided that the microprocessor calculates the standard color value components Cx and Cy from the standard color values X, Y, Z.

The invention claimed is:

1. An illumination system having at least two light sources of which at least one light source comprises an LED (11), characterized in that it furthermore comprises:

a driver device (22) that is designed to operate at least the one LED (11) with a DC signal;

a sensor device (12) with the aid of which at least one feature of the light output by the illumination system can be determined;

an actual value storage device (14) that is connected to the sensor device (12) and in which an actual value of the at least one feature can be stored;

a setpoint selection device (18) in which a setpoint of the at least one feature can be stored; and a control device (16) that is connected on the input side to the actual value storage device for the purpose of transmitting the actual value of the at least one feature, and to the setpoint selection device (18) for the purpose of transmitting the setpoint of the at least one feature, and which is designed to provide the driver device (22) at its output with a control signal in such a way that the driver device changes a characteristic of the DC signal used for driving the at least one LED (11) in such a way that the actual value approaches the setpoint.

2. The illumination system as claimed in claim 1, characterized in that the characteristic of the DC signal is its amplitude.

3. The illumination system as claimed in claim 1, characterized in that the sensor device (12) comprises at least one voltage frequency converter (26).

4. The illumination system as claimed in claim 3, characterized in that the at least one voltage frequency converter (26) is connected to at least one filter device (24) for the purpose of determining the actual value of the at least one feature of the light output by the illumination system.

5. The illumination system as claimed in claim 3, characterized in that the sensor device (12) comprises a microprocessor that is connected to the output of the at least one voltage frequency converter (26), in particular for the purpose of counting the pulses in the output signal of the at least one voltage frequency converter (26).

6. The illumination system as claimed in claim 1, characterized in that, in addition to the at least one light source that comprises at least one LED (11), at least one further light source is present that is of the following type:

LED;

fluorescent lamp;

halogen incandescent lamp;

high pressure discharge lamp.

7. The illumination system as claimed in claim 1, characterized in that the features of the light output by the illumination system is the color temperature and/or the brightness and/or the color locus.

8. The illumination system as claimed in claim 1, characterized in that the illumination system comprises at least two LEDs that output light of different color.

9. The illumination system as claimed in claim 1, characterized in that the setpoint selection device (18) has an interface (20) into which at least one setpoint can be input by an operator, or at least one setpoint can be selected from a number of setpoints already stored in the setpoint selection device (18).

10. The illumination system as claimed in claim 1, characterized in that the driver device (22) is designed to operate all the light sources of the illumination system.

11. The illumination system as claimed in claim 10, characterized in that parameters for operating the light sources are stored in the driver device (22) for the case in which the sensor device (12) and/or the actual value storage device (14) and/or the setpoint selection device (18) fails.

12. The illumination system as claimed in claim 1, characterized in that the components of the illumination system are designed for operating in a motor vehicle, in particular the supply voltage required for operating the components, the quality of the light output by the illumination system.

13. The illumination system as claimed in claim 12, characterized in that one setpoint corresponds to a dimming position of the illumination system.

14. The illumination system in claim 2, characterized in that the sensor device (12) comprises at least one voltage frequency converter (26).

* * * * *